United States Patent [19]

Fuwa

[11] Patent Number: 4,604,503

[45] Date of Patent: Aug. 5, 1986

[54] CHANGE-OVER SWITCH FOR AN ON-LOAD TAP CHANGER

[75] Inventor: Yasushi Fuwa, Itami, Japan

[73] Assignee: Mitsubishi Denki Kabushiki Kaisha, Tokyo, Japan

[21] Appl. No.: 681,194

[22] Filed: Dec. 13, 1984

[30] Foreign Application Priority Data

Dec. 15, 1983 [JP] Japan ..... 58-234975

[51] Int. Cl.[4] ..... H01H 19/54; H01H 1/16

[52] U.S. Cl. ..... 200/11 TC; 200/144 R; 200/277

[58] Field of Search ..... 200/8 R, 8 A, 9, 11 G, 200/11 J, 11 K, 11 TC, 17 R, 18, 252–261, 267, 144 R, 144 AP, 277

[56] References Cited

U.S. PATENT DOCUMENTS 3,632,908 1/1972 Bliebtreu et al. ..... 200/11 TC 4,356,359 10/1982 Dufranse et al. ..... 200/11 TC

FOREIGN PATENT DOCUMENTS 2235333 1/1974 Fed. Rep. of Germany ... 200/11 TC

*Primary Examiner*—J. R. Scott

*Attorney, Agent, or Firm*—Wenderoth, Lind & Ponack

[57] ABSTRACT

A change-over switch for an on-load tap changer comprising a main arcing roller contact for achieving the arc interrupting function upon tap changing, a current-carrying roller contact, disposed in axial alignment with the main arcing roller contact, for achieving the current-carrying function upon current carrying, a current-carrying bushing, rotatably extending through the axes of the current-carrying roller contact and the main arcing roller contact, for providing a current-carrying path upon tap changing and current carrying, and a roller contact holder supporting opposite ends of the current-carrying bushing and accommodating both of the main arcing roller contact and the current-carrying roller contact.

2 Claims, 7 Drawing Figures

CHANGE-OVER SWITCH FOR AN ON-LOAD TAP CHANGER

BACKGROUND OF THE INVENTION

This invention relates to change-over switches for an on-load tap changer, and more particularly to improvements in a main arcing roller contact and a current-carrying roller contact useful for a compact design.

FIG. 1 is a sectional view of a conventional two-resistor-type roller contact-type change-over switch for one phase power, hereinafter simply referred to as a change-over switch. FIG. 2 is an explanatory view taken along the line II—II of FIG. 1. This change-over switch comprises a cylindrical insulating housing 1, an arcing mechanism unit 2 for providing an arc interrupting function upon tap changing, a current-carrying mechanism unit 3 for providing a current-carrying function, and a collector mechanism unit 4 providing a current-collecting function during both the tap changing and the current carrying.

An arc interrupting roller contact or arcing roller contact or arcing roller 5 which is a main component of the arcing mechanism unit 2 is made of an arc resisting material and is composed of three members: a main arcing roller 5*a* and resistant arcing rollers, 5*b* and 5*c*, arranged on the left and right, respectively, of the main arcing roller 5*a* as viewed in FIG. 2. On the central axes of these arcing rollers 5*a*, 5*b*, and 5*c* are disposed a current-carrying bushing or arcing current-carrying bushing 6*a* for the main arcing roller 5*a* which is rotatable relative to the main arcing roller 5*a* as well as resistant current-carrying bushings 6*b* and 6*c* for the resistive arcing rollers which are rotatable relative to the resistive arcing rollers 5*b* and 5*c*. The arcing rollers 5*a*, 5*b* and 5*c* are supported by arcing roller contact holders or arcing holders 7*a*, 7*b* and 7*c* having a U-shaped cross section and the ends of the arcing current-carrying bushings 6*a*, 6*b* and 6*c* are respectively fixed thereto. The arcing holders 7*a*, 7*b* and 7*c* are mounted on a movable contact drive shaft 8. The movable contact drive shaft 8 is mounted on an insulating drive shaft 9 positioned on the center line of the insulating housing 1, and the movable contact drive shaft 8 is arranged to rotate by the rotation of the insulating drive shaft 9. Coil springs 10*a*, 10*b*, 10*c* are inserted under compression between the arcing holders 7*a*, 7*b*, 7*c* and the movable contact drive shaft 8, and the respective arcing holders 7*a*, 7*b* and 7*c* are always biased in the radial direction by the spring function of the coil springs 10*a*, 10*b*, 10*c*. Therefore, the arcing rollers 5*a*, 5*b* and 5*c* are pressed against the arcing fixed contacts 11A, 11B which are fixed at equal intervals on the inner periphery of the wall of the insulating housing 1 and made of an arc resistive material. Reference numeral 12*a* designates one of three stoppers for determining the wiping distance upon the separation of the arcing rollers 5*a*, 5*b* and 5*c*; the other two stoppers not being shown in the drawings.

A principle roller contact current-carrying roller contact 13 (hereinafter referred to as a current-carrying roller) which is a main component of the current-carrying mechanism unit 3 is made of an electrically conducting material, and a current-carrying bushing 14 for a current-carrying roller is rotatably mounted on its central axis. The current-carrying roller 13 is supported on the movable contact drive shaft 8 by a current-carrying roller contact holder or current-carrying holder 15 disposed immediately below the main arcing holder 7*a* with the opposite ends of the current-carrying bushing 14 secured thereto. Similarly to the arcing mechanism unit 2, a coil spring 16 is compressed between the current-carrying holder 15 and the movable contact drive shaft 8, and a stopper 17 is mounted to the current-carrying holder 15, which function in the same manner as described in conjunction with the arcing mechanism unit 2. The current-carrying roller 13 is arranged to cause the current-carrying fixed contacts 18A and 18B fixed, at equal intervals, on the inner periphery of the wall of the insulating housing 1 to be pressed upon by the spring action of the coil spring 16. The current-carrying fixed contacts 18A and 18B are made of an electrically conductive material and are disc shaped, and are centrally positioned immediately below the arcing fixed contacts 11A and 11B.

A current-collecting roller contact of collecting roller 19 which is a main component of the collector mechanism unit 4 is also supported on the movable contact drive shaft 8 by a current-collecting roller contact holder or current-collecting holder 20 disposed immediately below the main arcing holder 7a in a manner similar to the current-carrying mechanism unit 3 through a current-carrying bushing or current-collecting current-carrying bushing 21 for the current-collecting roller. A coil spring 22 and a stopper 23 having a function similar to that of the arcing mechanism unit 2 are provided within the current-collecting mechanism 4. The current-collecting roller 19 is arranged to press the current-collecting fixed contact 24 disposed on the inner peripheral wall of the insulating housing 1 by the spring action of the coil spring 22. The current-collecting fixed contact 24 is secured on the inner peripheral wall of the insulating housing 1 in the circumferential direction.

On the outer peripheral wall of the insulating housing 1, fixed contact terminals or fixed terminals 26 connected to transformer leads 25 extending from the respective taps in correspondence with the arcing fixed contacts 11A and 11B and the current-carrying fixed contacts 18A and 18B. Also, on the outer peripheral wall of the insulating housing 1, current-collecting contact terminals or current-collecting terminals 28 connected to leads 27 from the transformer main winding are provided in correspondence with the current-collecting fixed contacts 24.

As shown in FIG. 2, the main arcing current-carrying bushing 6*a* and the current-collecting current-carrying bushing 21 are connected by leads 29. Further, the resistant current-carrying bushings 6*b* and 6*c* and the current-collecting current-carrying bushing 21 are connected by leads 31 through a current-limiting resistor 30 mounted on the insulating drive shaft 9. The current-carrying bushing 14 and the current-collecting current-carrying bushing 21 are connected by connecting leads 32.

The operation of the above construction will now be described. In the current-carrying (stop) mode, the current flows through a circuit of the transformer leads 25 to the fixed terminal 26 to the current-carrying fixed contact 18A to the current-collecting roller 13 to the bushing 14 to the connecting leads 32 to the current-collecting current-carrying bushing 21 to the current-collecting roller 19 to the current-collecting fixed contact 24 to the current-collecting terminal 28 and to the leads 27. At this time, since the conductivity of the arcing fixed contact 11A is slightly poorer than that of the current-carrying fixed contact 18A, almost no current flows from the fixed terminal 26 to the arcing fixed contact 11A.

During tap changing, the movable contact drive shaft 8 is rotated by a rotational force applied from the insulating drive shaft 9, and the current-carrying roller 13 is released from the current-carrying fixed contact 18A while being rotated. Therefore, the current path to the current-carrying roller 13 is interrupted and the load current flows into the main arcing roller 5*a* in a condition with almost no arc. Thus, the load current flows through the transformer leads 25 to the fixed terminal 26 to the arcing fixed contact 11A to the main arcing roller 5*a* to the arcing current-carrying bushing 6*a* to the leads 29 to the current-collecting current-carrying bushing 21 and successively through roller 19, contact 24 and terminal 28 along the same current path as previously described into the leads 27.

Further, as the movable contact drive shaft 8 rotates, the main arcing roller 5*a* separates from the arcing fixed contact 11A while interrupting an electric arc, so that the current is transferred to the resistant arcing roller 5*b*. The current flows through the transformer leads 25 to the fixed terminal 26 to the arcing fixed contact 11A to the resistant arcing roller 5*b* to the resistant current-carrying bushing 6*b* to the leads 31 to the current-limiting resistor 30 to the leads 31 to the current-collecting current-carrying bushing 21 to further flow successively through roller 19, contact 24 and terminal 28 into the leads 27 along the same path as above described. Further, as the movable contact drive shaft 8 rotates, after a bridging condition in connection with the resistant arcing rollers 5*b* and 5*c* and the arcing fixed contacts 11A and 11B is experienced, the resistant arcing rollers 5B interrupts the arc, whereby the current flows into the resistant arcing roller 5*c*. Then, the main arcing roller 5*a* is brought into contact with the arcing fixed contact 11B of the next tap, and the load current path again shifts to the main arcing roller 5*a*. Finally, the current-carrying roller 13 is brought into contact with the current-carrying fixed contact 18B, thereby completing the tap changing to provide a current-carrying condition.

Since a conventional roller contact type changer-over switch is separated between the arcing mechanism unit 2 and the current-carrying mechanism unit 3 as above described, the volume of the entire apparatus is disadvantageously large. Also, since the arcing mechanism unit 2 and the current-carrying mechanism unit 3 are separately constructed, two sets of parts (two sets of roller contact holders 7*a*, 15, two sets of current-carrying bushings 6*a*, 14, two sets of coil springs 10*a*, 16, etc.) are necessary. Not only does the number of parts become large, but their manufacture and assembly becomes complicated since a part for the arcing mechanism unit 2 is not identical in structure to the corresponding part in the current-carrying mechanism unit 3. The cost of manufacturing and assembly therefore increases.

SUMMARY OF THE INVENTION

Accordingly, an object of the present invention is to provide a change-over switch for an on-load tap changer from which the above disadvantages of the conventional design are eliminated.

Another object of the present invention is to provide a change-over switch for an on-load tap changer in which a current-carrying bushing is rotatably and concentrically inserted into the main arcing roller contact and the current-carrying roller contact, and the main arcing roller and the current-carrying roller contact are accommodated within a roller contact holder which supports the opposite ends of the current-carrying bushing, thereby enabling the entire apparatus to become compact and reducing the number of the parts required.

With the above objects in view, a change-over switch for an on-load tap changer of the present invention comprises a main arc roller contact for achieving the arc interrupting function upon tap changing, a current-carrying roller contact, disposed in axial alignment with the main arcing roller contact, for achieving the current-carrying function upon current carrying, a current-carrying bushing, rotatably extending through the axes of the current-carrying roller contact and the main arcing roller contact, for providing a current-carrying path upon tap changing and current carrying, and a roller contact holder supporting opposite ends of the current-carrying bushing and accommodating both of the main arcing roller contact and the current-carrying roller contact.

BRIEF DESCRIPTION OF THE DRAWINGS

The invention will become more readily apparent from the following detailed description of the embodiment thereof taken in conjunction with the accompanying drawings, in which.

DESCRIPTION OF THE PREFERRED EMBODIMENTS

Figure 1:
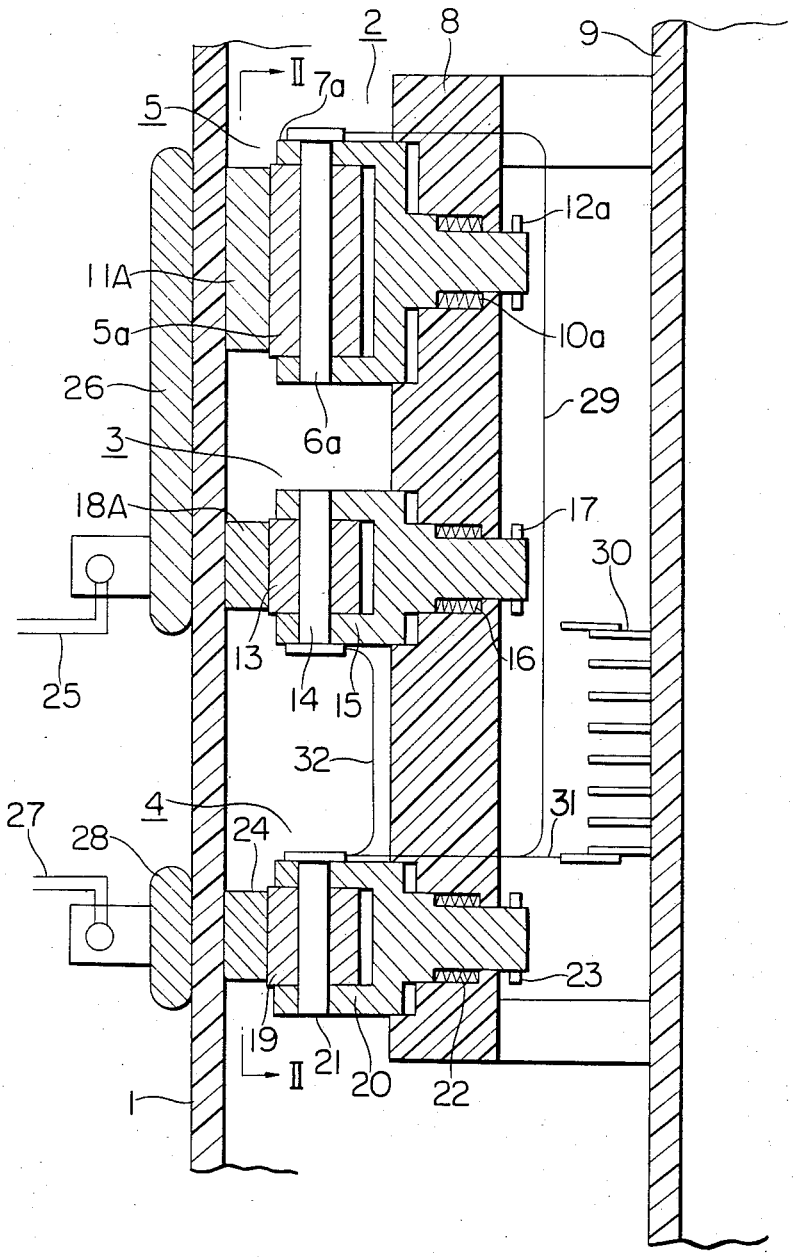
FIG. 1 (PRIOR ART)
FIG. 1 is a sectional view of the main portion of a conventional change-over switch for an on-load tap changer.
Figure 2:
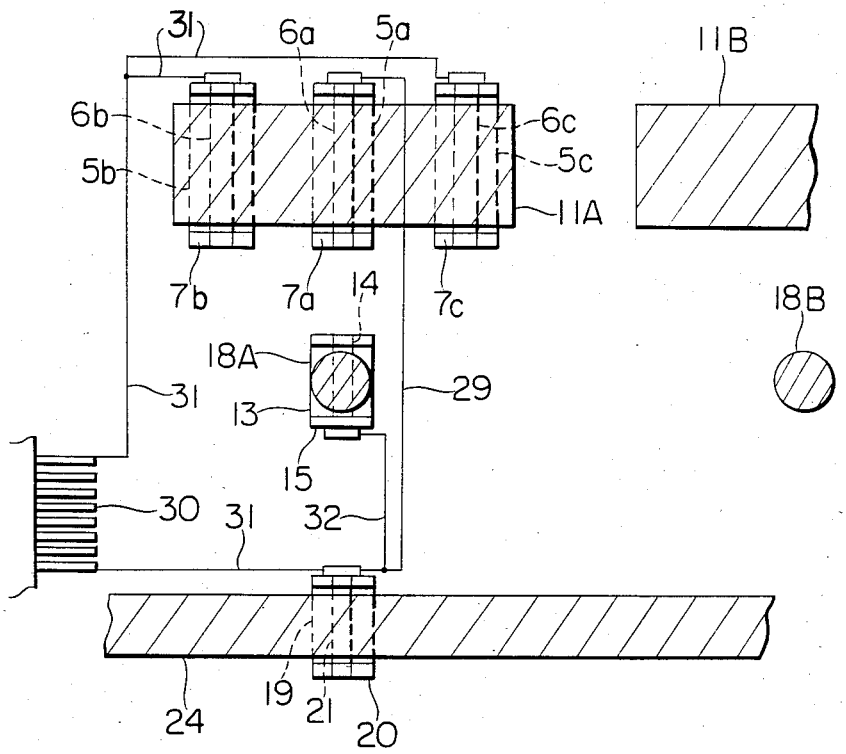
FIG. 2 (PRIOR ART)
FIG. 2 is a schematic explanatory view taken along the line II—II of FIG. 1.
Figure 3:
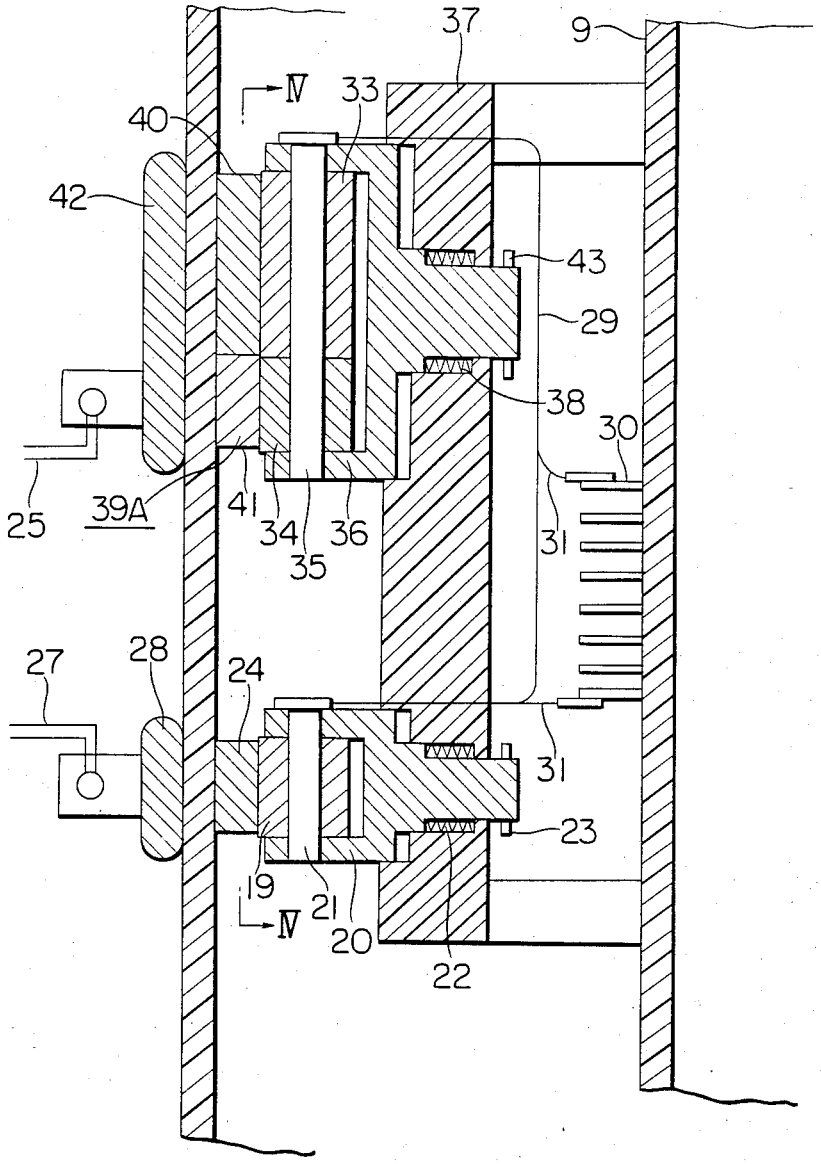
FIG. 3 is a schematic view of the main portion of one embodiment of the present invention.
Figure 4:
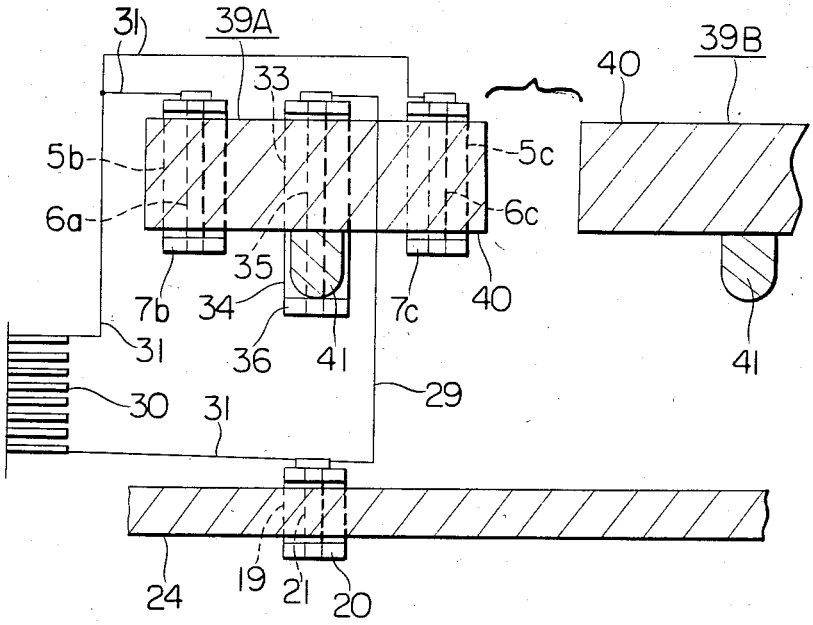
FIG. 4 is a schematic explanatory view taken along the line IV—IV of FIG. 3.

One embodiment of the present invention will now be described with reference to the drawings. FIG. 3 is a partially sectional view showing one embodiment of a change-over switch for an on-load tap changer of the present invention, and FIG. 4 is a schematic explanatory view taken along the line IV—IV of FIG. 3, for which an explanation is omitted as to components which are the same or identical to components shown in FIGS. 1 and 2. A main arcing roller contact or a main arcing roller 33 made of an arc resistant material and a current-carrying roller contact or current-carrying roller 34 made of an electrically conductive material are cylinders of the same diameter, and they are joined together at their end faces. A current-carrying bushing 35 rotatably extends through and along the central axes of the main arcing roller 33 and the current-carrying roller 34, and the current-carrying bushing 35 is supported at its opposite ends by a roller contact holder 36 having a U-shaped cross section. This holder 36 is mounted on a movable contact drive shaft 37 to which the rotational force of the insulating drive shaft 9 is transmitted. A coil spring 38 is compressed between the roller contact holder 36 and the movable contact drive shaft 37, and the roller contact holder 36 is always biased in the radial direction by the spring action of the coil spring 38. Therefore, both the main arcing roller 33 and the current-carrying roller 34 engage fixed contacts 39A and 39B secured at equal circumferential intervals on the inner peripheral wall of the insulating housing 1 under pressure by the coil spring 38. The fixed contacts 39A and 39B have a substantially T-shaped configuration, and an upper arcing portion 40 against which the main arcing roller 33 is pressed is made of an arc resistant material, and a lower current-carrying portion 41 against which the current-carrying roller 34 is pressed is made of an electrically conductive material. On the outer peripheral wall of the insulating housing 1, a fixed contact terminal or fixed terminal 42 connected to the transformer leads 25 from the respective taps are provided in correspondence with the fixed contacts 39*a* and 39B. Reference numeral 43 designates a stopper which determines the wiping distance upon the release of the main arcing roller 33 and the current-carrying roller 34.

The operation of the above-described structure will now be described. During current carrying (stopping) condition, the current flows through the transformer leads 25 to the fixed terminal 42 to the current-carrying portion 41 to the current-carrying roller 34 to the current-carrying bushing 35 and further along the same path as the previously described conventional design. Since the conductivity of the arcing portion 40 is slightly less than that of the current-carrying portion 41, almost no current flows through the fixed terminals 42 into the arcing portion 40.

Upon tap changing, the movable contact drive shaft 37 is rotated by a rotating force applied to separate the current-carrying roller 34 from the current-carrying portion 41. Therefore, the load current flows into the current-carrying bushing 35 from the arcing portion 40 through the main arcing roller 33 with almost no arcing because of breaking of the path to the current-carrying roller 34, and further flows through the same path as that previously described in connection with the current-carrying condition. Further rotation of the movable contact drive shaft 37 causes the main arcing roller 33 to separate from the arcing portion 40 while interrupting the arc, the current path being shifted to the resistant arcing roller 5*b*. The operation thereafter is the same as that of the conventional construction and the explanation thereof is omitted.

Figure 5:
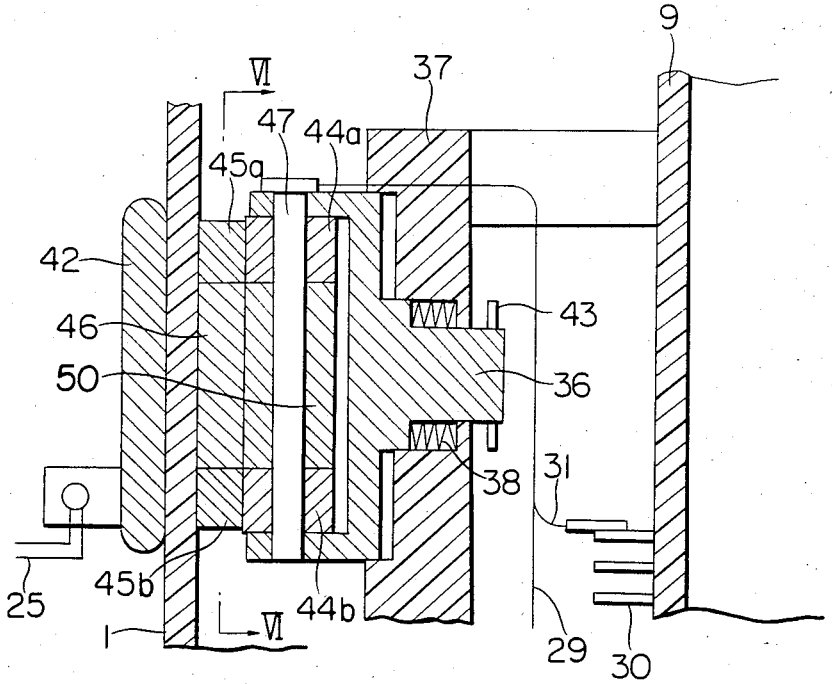
FIG. 5 is a sectional view of the main portion showing another embodiment of the present invention.
Figure 6:
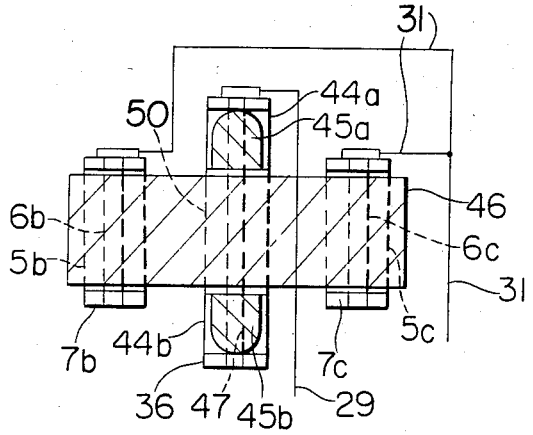
FIG. 6 is a schematic explanatory view taken along the line VI—VI of FIG. 5.

Further, while the description has been made in conjunction with the arrangement in which the current-carrying roller 34 is disposed below the main arcing roller 33, current-carrying rollers 44*a* and 44*b* may be disposed on the upper and lower sides of the main arcing roller 33 as shown in FIGS. 5 and 6. In this modification, the current-carrying rollers 44*a* and 44*b* are in contact with the current-carrying portion 45*a* and 45*b* at the upper and the lower portions, so that the area of contact is large, enabling application to a large current region. Furthermore, the respective contact portions do not apply a biased load on the current-carrying bushing 47 even when the arcing roller 50 and the arcing portion 46 are worn, ensuring reliable current carrying and switching.

Figure 7:
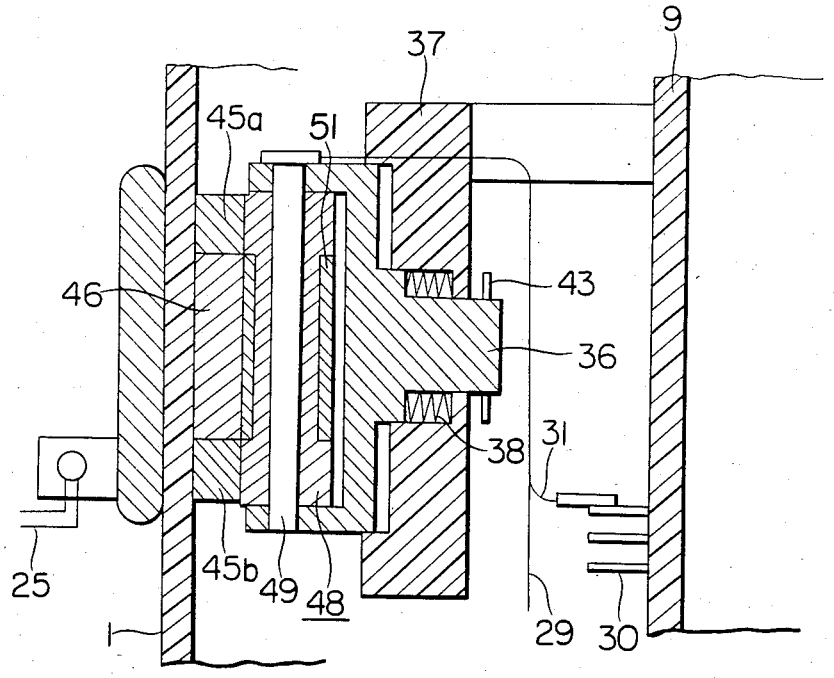
FIG. 7 is a sectional view showing still another embodiment of the present invention.

Furthermore, as shown in FIG. 7, the main arcing roller 50 and the current-carrying roller 44*a* and 44*b* shown in FIGS. 5 and 6 may be made completely integral with each other by sintering with a copper material to form a roller contact 48 on which an arc resistant metal 51 (for example, copper-tungsten) is attached at the position corresponding to the outer periphery of the main arcing roller 50 shown in FIG. 5. In this embodiment, the outer peripheral surface of the current-carrying bushing 49 and the inner peripheral surface of the roller contact 48 contact over their entire surfaces, so that the areas on which the pressure is applied are large. This reduces wear and ensures reliable operation. Also, the number of the parts is further reduced as compared to the embodiment shown in FIGS. 5 and 6.

Also, in the above embodiments, although the description has been made in conjunction with a change-over switch of the two-resistor type, the present invention is not limited thereto and a similar advantage is equally obtained with a single resistor type.

As has been described, according to the present invention, a change-over switch for an on-load tap changer is provided, in which a current-carrying bushing is rotatably and concentrically inserted into the main arcing roller contact and the current-carrying roller contact, and the main arcing roller and the current-carrying roller contact are accommodated within a roller contact holder which supports the opposite ends of the current-carrying bushing, thereby enabling the entire apparatus to become compact and reducing the number of the parts required.

What is claimed is:

1. A change-over switch for an on-load tap changer, comprising:

a cylindrical housing having a first center axis, and having a plurality of stationary contacts fixed to the cylindrical periphery thereof, said plurality of stationary contacts including first and second stationary contacts subtending different overlapping angular arcs about said first center axis;

an electrically conductive bushing having a second center axis parallel said first center axis;

a principle roller contact and an arc interrupting roller contact electrically connected to said bushing, having peripheral surfaces movable circumferentially with respect to said center axis into and out of engagement with said stationary contacts and rotatably mounted in axial alignment on said bushing for rotation about said second center axis, said principle roller contact and said arc interrupting roller contact being integrally formed of an electrically conductive roller member having a first cylindrical surface exposed so as to be rollable on said first stationary contact and an unexposed second cylindrical surface, said arc interrupting roller contact including a cylindrical layer of arc resistive material formed on said unexposed second cylindrical surface so as to be rollable on said second stationary contact;

a roller contact holder supporting axially opposite ends of said bushing; and means, engaging said roller contact holder, for rotating said principle roller contact and said arc interrupting roller contact about said first center axis such that said principle roller and said arc interrupting roller respectively roll successively on and off said first and second stationary contacts.

2. A switch as in claim 1, wherein said electrically conductive roller member has two exposed cylindrical surfaces on axially opposed sides of said unexposed second cylindrical surface, disposed so as to be rollable on different ones of said stationary contacts.

* * * * *